US007178714B2

(12) United States Patent
Skrdlant

(10) Patent No.: US 7,178,714 B2
(45) Date of Patent: Feb. 20, 2007

(54) CONTAINER FOR FLAT OBJECTS IN A VERTICAL POSITION

(75) Inventor: Rolf-Peter Skrdlant, Constance (DE)

(73) Assignee: Siemens AG, München (DE)

( * ) Notice: Subject to any disclaimer, the term of this patent is extended or adjusted under 35 U.S.C. 154(b) by 89 days.

(21) Appl. No.: 11/024,695

(22) Filed: Dec. 30, 2004

(65) Prior Publication Data

US 2005/0139646 A1 Jun. 30, 2005

Related U.S. Application Data

(63) Continuation of application No. PCT/DE03/02164, filed on Jun. 30, 2003.

(30) Foreign Application Priority Data

Jul. 10, 2002 (DE) ..... 102 31 305

(51) Int. Cl.
*A45C 1/12* (2006.01)

(52) U.S. Cl. ..... 232/1 D; 220/9.1; 220/9.2; 209/900; 232/30

(58) Field of Classification Search ..... 232/30–32, 232/17, 1 D, 43.4; 220/4.28, 6, 9.1, 9.2, 220/9.4; 209/900
See application file for complete search history.

(56) References Cited

U.S. PATENT DOCUMENTS 1,755,764 A * 4/1930 Benedict et al. ..... 29/237.5
3,557,855 A * 1/1971 Weingarten et al. ..... 206/386
5,833,076 A * 11/1998 Harres et al. ..... 211/51
6,276,548 B1 * 8/2001 Mitchell ..... 220/9.4
2003/0108416 A1 * 6/2003 Schererz et al. ..... 414/794.4
2005/0161457 A1 * 7/2005 Enenkel et al. ..... 220/532

FOREIGN PATENT DOCUMENTS

DE 3300354 A1 7/1984
DE G9211696.5 4/1993
DE G9417521.7 3/1995
DE 4405600 C2 8/1995

(Continued)

OTHER PUBLICATIONS

Abstract—EP-0 109 325; May 23, 1984; clamping stackable tote box of the type with significantly vertical supporting pillars; Allibert S.A.; F38042 (France).

(Continued)

*Primary Examiner*—William L. Miller
(74) *Attorney, Agent, or Firm*—Siemens AG

(57) ABSTRACT

The invention relates to a container for flat objects in a vertical position, comprising a base, two lateral longitudinal sides and two front sides, the flat objects being aligned with their largest surfaces facing the front sides. At least one front side consists of at least one material web, whose axes run parallel to the base, which is mobile in relation to the front side and can be displaced downwards into a gap in the base. The material web is flexible and thin and is suspended by its ends that run perpendicular to the longitudinal sides between two bars. The lower bar is configured in the gap in the base and is displaceable and the upper bar can be displaced between the base and the upper edge along the front delimitation of the longitudinal sides.

7 Claims, 4 Drawing Sheets

FOREIGN PATENT DOCUMENTS

| | | |
|---|---|---|
| DE | 19545716 C1 | 9/1996 |
| DE | 29906231 U1 | 9/1999 |
| EP | 0 109 325 A1 | 5/1984 |
| FR | 2 621 297 | 4/1989 |

OTHER PUBLICATIONS

Abstract—FR-2 621 297; Apr. 7, 1989; clamping stackable tote box; Allibert S.A.; F38042 (France).

Derwent Abstract—DE-4405600 C2; Aug. 24, 1995; Paper batching container for use on gravity=roller conveyors has vertical flat guide surfaces in internal space of container, and closing device for emptying aperture divided into two symmetrical closing halves; Matschkur Goetz Lindner, D-90402 Nümberg (Germany).

Derwent Abstract—DE-3300354 A1; Jul. 12, 1984; Cover for transport container has four sections forming top and two sides slid outwards for unobstructed access to interior; Deutsche Bundesbahn, D-4950 Minden (Germany).

Derwent Abstract—DE-29906231 U1; Sep. 23, 1999; Transport storage container with base plate and oppositely arranged roof plate.

Derwent Abstract—DE-19545716C1;Sep. 5, 1996;Device for automatic loading material input of letter distribution unit has sepg.blade movable in transport direction of letters,pivoting inwards and outwards as well asmoving backwards,also having letter reception device;Licentia Patent-Verwaltungs GmbH;D-60596 Frankfurt Germany.

Abstract—GM- G92 11 696.5; Apr. 22, 1993; Transport container of plastic; Stucki Kunststoffwerk und Werkzeugbau GmbH, D-4902 Bad Salzuflen (Germany).

Abstract—GM- G94 17 521.7; Mar. 9, 1995; Transport container; Thyssen Polymer GmbH, D-81671 München (Germany).

* cited by examiner

CONTAINER FOR FLAT OBJECTS IN A VERTICAL POSITION

CROSS REFERENCE TO RELATED APPLICATIONS

The present application is a continuation of international application PCT/DE2003/002164, filed 30 Jun. 2003, which designated the United States, and further claims priority to German patent application 10231305.9, filed 10 Jul. 2002, the both of which are herein incorporated by reference.

BACKGROUND OF THE INVENTION

The invention relates to a container for flat objects in a vertical position. These objects can be, for example, flat items of mail of different formats. Modern letter sorting systems reach peak throughputs of up to 45,000 items of mail per hour. As a rule, emptying is carried out manually, that is to say the sorted stacks of items of mail are transferred by hand from the sorter into mail containers. In the process, the items of mail have to be put into the mail containers from above. The mail containers themselves are then either stacked manually onto carts or transferred to tray management systems. This manual process is associated with a high error rate on the part of the operator, high physical stress on the operator and low throughputs.

During the supply of the items of mail into the sorters, there is likewise generally a manual transfer from containers to the separating apparatus of the sorter.

During this unloading process, the items of mail are lifted out of the container, shaken out or the container is tipped upside down and lifted off the items of mail (DE 195 45 716 C1). In particular in the case of items of mail with different formats or items of mail with large formats, this procedure is complicated or even not possible at all without the alignment of the items of mail on two edges being lost.

In EP 0 109 325, FR 2 621 297, mail containers needed for this purpose are described. These consist of plastic (PP) and have various reinforcements in order to achieve the necessary dimensional stability. These containers are configured in such a way that, if they are aligned mutually with one another and aligned so as to be rotated through 180° about the vertical axis in relation to one another, they can be stacked in one another.

An appropriate container for flat objects, such as letters, in a vertical position has also been described in DE 94 17 521 U1.

Also known is a container having an end wall which is designed as a roller shutter which can be displaced downward into an intermediate space in the bottom (DE 92 11 U1). This roller shutter solution is relatively heavy and needs a great deal of space.

SUMMARY OF THE INVENTION

The invention is therefore based on the object of providing a container for flat objects in a vertical position, having at least one end wall which can be displaced downward into an intermediate space in the bottom and which, as compared with the prior art, is designed to be lightweight and space-saving.

The material web consists of a flexible thin material web which, at its ends running perpendicular to the longitudinal walls, is spread out between two rods.

The lower rod is guided in the interspace in the bottom and can be moved, and the upper rod can be displaced between the bottom and upper edge along the front boundary of the longitudinal walls. Here, at their lateral ends on each longitudinal side of the container, the rods are guided jointly in a retaining mechanism which is fixed to the long walls such that it can be pivoted and holds the material web. The retaining mechanism comprises three rotating levers, to whose ends oriented toward the end of the container the upper rod is fixed. They are mounted approximately in the center of their longitudinal direction such that they can be rotated on the lateral longitudinal walls, the two axes of rotation being aligned and perpendicular to the longitudinal walls. The lower rod is connected to the other ends of the levers via floppy elongated pulling elements, which are deflected on the bottom, so that the material web/s remain/s spread out over its/their length in any pivoted position. This solution is lightweight, space-saving and uncomplicated.

It is advantageous if the pulling elements are elastic and under prestress.

As a result, tolerances which occur can be compensated for, so that the material web can be kept continually taut.

In order to limit the pivoting movement of the retaining mechanisms, the lateral longitudinal walls advantageously have stops.

The lateral longitudinal walls preferably have recesses on the outside, in which the levers are arranged to be countersunk such that they can be rotated and which can be closed by external coverings. This avoids the retaining mechanism being hampered during its movement. In order to relieve the material webs of tensile stresses, it is advantageous to fix flexible tensile straps of the same length as the material webs between the two rods.

It is also advantageous if the material web/s has/have a handle cutout on the upper rod. As a result, the upper rod can be used as a carrying handle.

In a further advantageous refinement, a plurality of thin flexible material webs are fixed to the two rods at a distance from one another. In the region of the gaps, at the end between the material webs, the bottom has lugs which dip into the slots between the material webs and in this way prevent objects being drawn in between the material web and bottom when the container is opened.

BRIEF DESCRIPTION OF THE SEVERAL VIEWS OF THE DRAWINGS

The invention will now be explained in more detail in an exemplary embodiment and by using the drawing, in which.

DETAILED DESCRIPTION OF THE INVENTION

Figure 1:
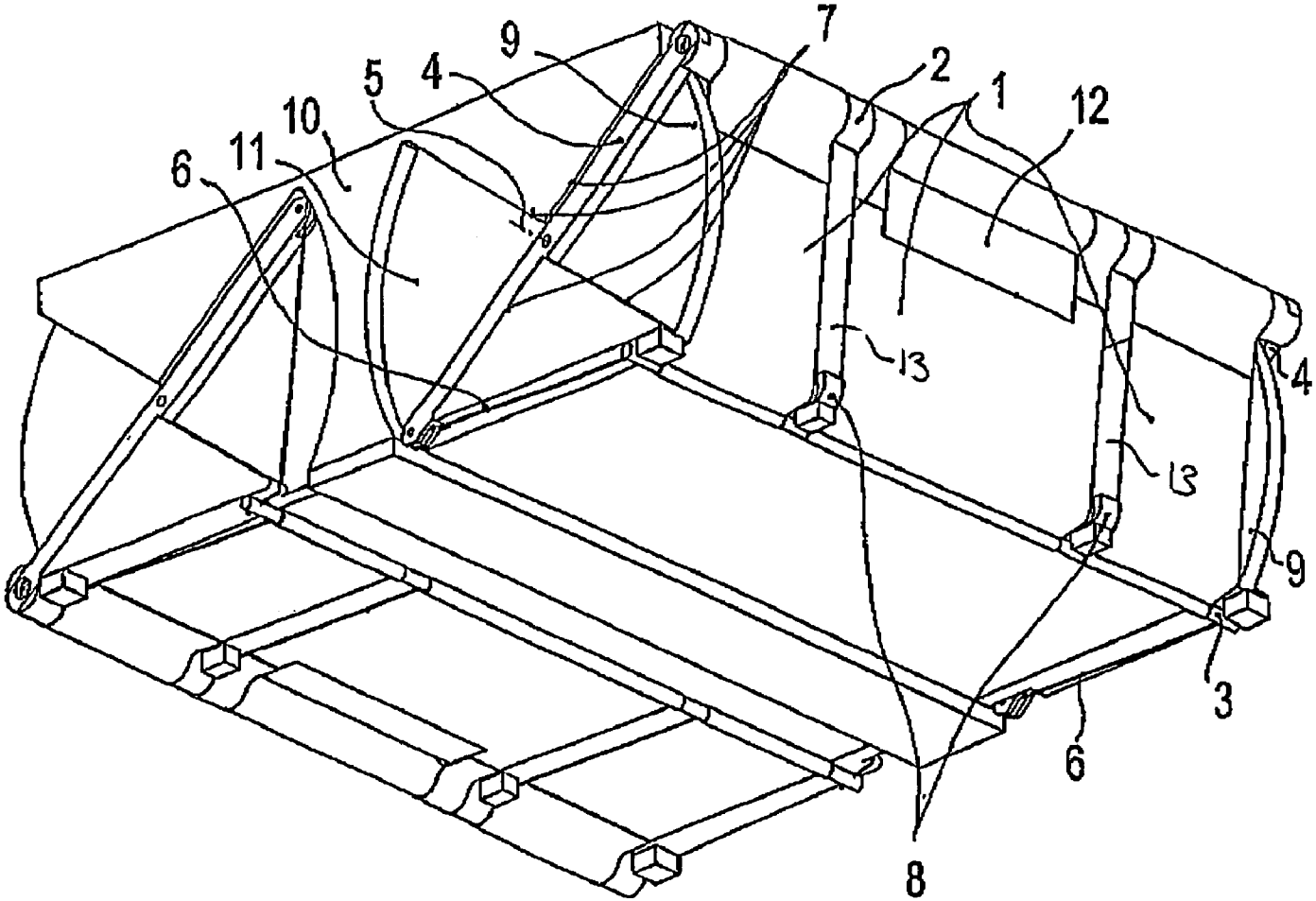
FIG. 1 shows a perspective schematic illustration of the container with a view obliquely from below of the bottom, front end closed, rear end opened, lower outer covering of the bottom and outer covering of the lateral longitudinal walls not illustrated.
Figure 2:
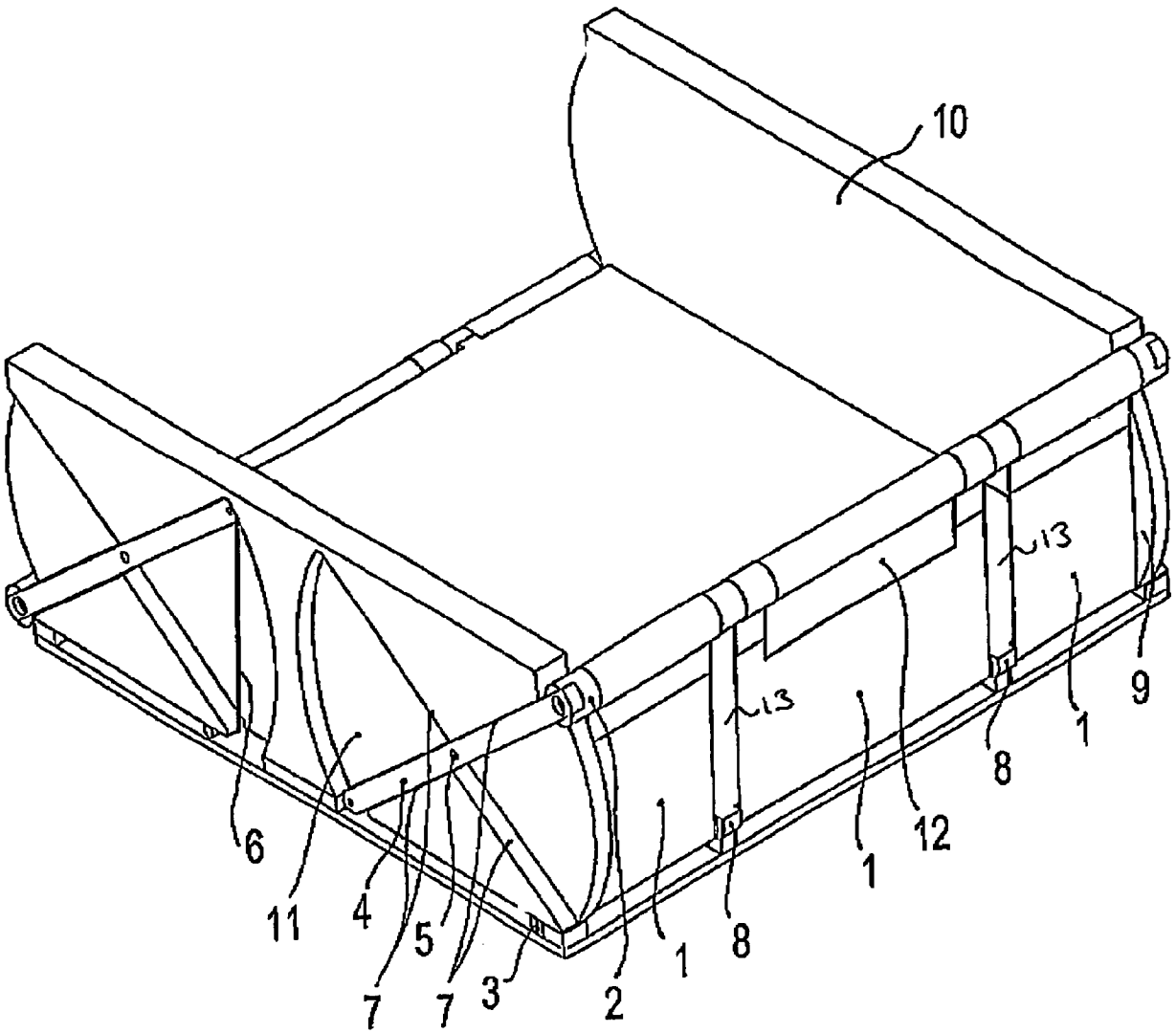
FIG. 2 shows a perspective schematic illustration of the container with a view obliquely from above of the container opening, front end closed, rear end opened.
Figure 3:
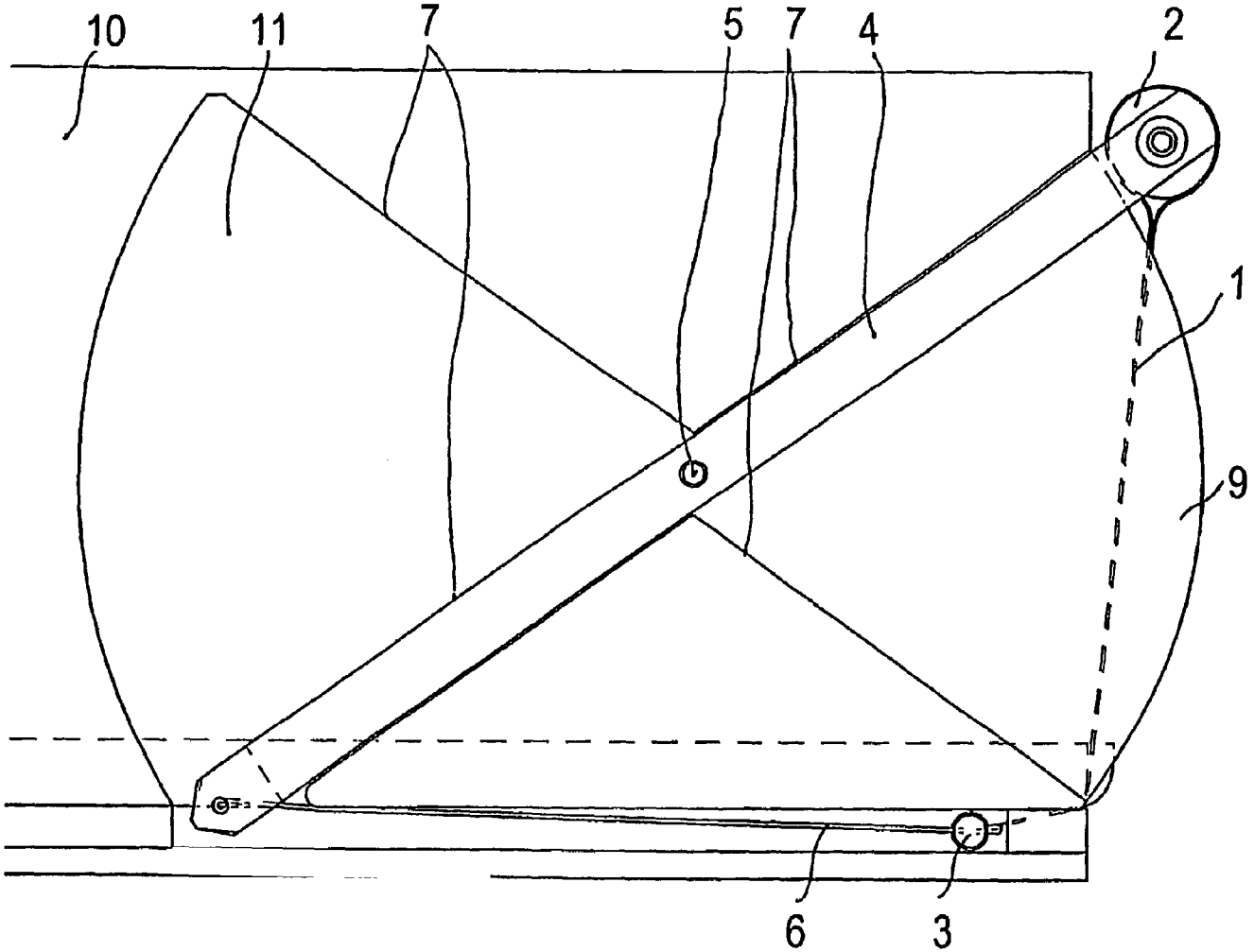
FIG. 3 shows a partial view at right angles to a lateral longitudinal wall of the container, end closed.
Figure 4:
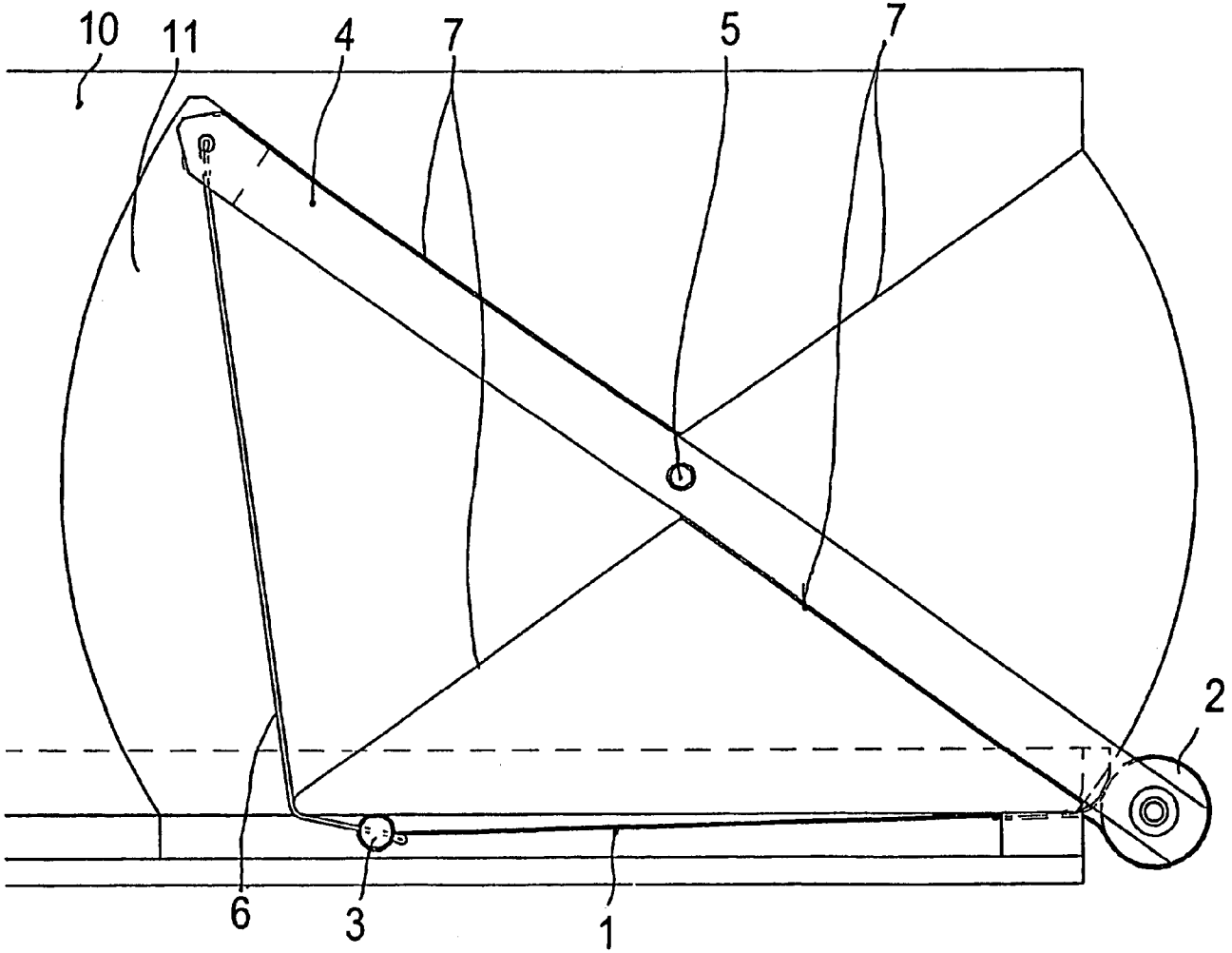
FIG. 4 shows a partial view at right angles to a lateral longitudinal wall of the container, end opened.

The container has two lateral longitudinal walls 10 and two end walls. The end walls can be opened and closed independently of each other. Opening is carried out by means of simply pressing the end wan downward and closing by means of simply pulling the end wall upward. An end wall comprises three broad, parallel, flexible thin material webs 1 which, at their end running perpendicularly with respect to the longitudinal walls 10, are spread out between two rods 2,3. The upper rod 2 is formed as a handle bar. In the center of the handle bar, the central material web has a corresponding handle cutout (12). The lower rod 3 is located in an interspace in the bottom. The handle bar is fixed at the lateral ends to two parallel levers 4, which are mounted such that they can rotate on coaxial axes 5 perpendicular to the lateral longitudinal walls 10. Running between upper rod 2 and lower rod 3 are fixed flexible tension straps 13 with a substantially similar length as the material web. The levers 4 are designed so as to be countersunk in recesses (11) whose boundaries form stop surfaces 7 for the levers 4, the position of the stop surfaces 7 being chosen such that, in the upper position, the handle bar is located slightly below the upper edge of the lateral longitudinal walls 10 and, in the lower position, is located underneath the supporting surface of the bottom. Here, to stops are located symmetrically with respect to a horizontal plane through the axis of rotation 5. In addition, the stop surfaces 7, the diameter of the handle bar and to thickness of the bottom are designed such that the handle bar is located in the region underneath the inner surface of the container bottom and above the outer surface of the container bottom when the end of the container is opened.

At the ends, the longitudinal walls 10 have extensions which are shaped like circular arcs, project beyond the bottom and prevent objects slipping through the gap between longitudinal wall 10 and material web 1. In the recesses in each lateral longitudinal wall 10, between the other end of the levers 4 and the lower rod 3, in each case an elastic pulling element 6 is fixed in the bottom. It is in each case deflected at two rounded edges in the longitudinal wall 10 and is under slight prestress, by which means the end wall is spread out.

As viewed in the direction of the axis of rotation 5, the levers 4 form with the material webs 1 spread out between the handle bar/upper rod 2 and the lower rod 3 and the pulling elements 6 a "self-contained unit" with an approximately constant arc length which, as the container is opened and closed, is subjected to only slight fluctuations, which are compensated for by the elastic pulling elements 6. The material webs 1 by means of which the ends of the container are closed are pulled into the interspace in the bottom by the pulling elements 6 at the lower rod 3 as the container is opened. As the container is opened, the material webs 1 are pulled out of the interspace in the bottom by the handle bar and pulled upward again. In order that, when the container is opened, no flat objects are pulled into the gap between the material webs 1 and the bottom, there are spaces between the parallel material webs 1. In these regions, the bottom is lengthened by projecting lugs 8, which dip into the spaces between the material webs 1 and thus prevent objects being pulled in between material webs 1 and container bottom as the container is opened.

As a result of the prestress of the pulling elements 6, the friction between the moving elements and the container rises, which means that the force for opening and closing and the actual locking force of the entire closing mechanism is increased in the opened and closed position and in possible intermediate positions. If the inherent locking force of the closing mechanism resulting from friction is not sufficient since, for example, forces act on the handle bar as a result of a tilting stack of flat objects, it is advantageous to provide an additional locking means. This can be designed, for example, in the form of spring-loaded ball catches which, in the closed position, latch into one or both levers 2, 3.

I claim:

1. A container, comprising:

a bottom comprising an interspace, two lateral longitudinal walls defining a front boundary, two end walls, an upper and a lower rod each having lateral ends and arranged to be guided and displaceable in the interspace, the upper rod being displaceable from the bottom to an upper edge of the container along the front boundary, at least one of the end walls comprising a material web displaceable in a direction toward the bottom and further displaceable downward into the interspace, the material web comprising a flexible thin material web arranged such that the flexible thin material web ends run perpendicular to the longitudinal walls of the container and is spread out between the upper and lower rods, and rotatable levers arranged so as to be connected at one end thereof to the upper rod lateral ends, the levers are rotatably mounted, approximately in the center of their longitudinal direction, such that they can be rotated on the lateral longitudinal walls, the axes of rotation of the levers being aligned and perpendicular to the longitudinal walls, the rotatable levers being further arranged such that the lower rod is connected to other ends of the levers via floppy elongated pulling elements which are deflected at the bottom so that the material web remains spread out aver its length in any pivoted position.

2. The container according to claim 1, wherein the pulling elements are elastic and under slight prestress.

3. The container according to claim 1, wherein the lateral longitudinal walls have stops arranged to limit pivoting movement of the levers.

4. The container according to claim 1, wherein the lateral longitudinal walls comprises recesses on the outside, the recesses arranged such that the levers are arranged therein to be countersunk such that they can be rotated.

5. The container according to claim 1, wherein between the two rode there are fixed flexible tension straps with a substantially similar length as the material web.

6. The container according to claim 1, wherein the material web has a handle cutout by the upper rod.

7. The container according to claim 1, wherein a plurality of material webs are fixed to the upper and lower rods at a distance from one another and projecting lugs are arranged on the bottom between the material webs.

* * * * *